US008961252B2

(12) United States Patent
Gadler

(10) Patent No.: US 8,961,252 B2
(45) Date of Patent: Feb. 24, 2015

(54) BUOYANCY VEST

(71) Applicant: WaveWrecker, LLC, El Cajon, CA (US)

(72) Inventor: Nicholas N. Gadler, El Cajon, CA (US)

(73) Assignee: WaveWrecker, LLC, El Cajon, CA (US)

( * ) Notice: Subject to any disclaimer, the term of this patent is extended or adjusted under 35 U.S.C. 154(b) by 175 days.

(21) Appl. No.: 13/769,718

(22) Filed: Feb. 18, 2013

(65) Prior Publication Data

US 2013/0217281 A1 Aug. 22, 2013

Related U.S. Application Data

(60) Provisional application No. 61/600,441, filed on Feb. 17, 2012.

(51) Int. Cl.

| | |
|---|---|
| ***B63C 9/08*** | (2006.01) |
| ***B63C 9/115*** | (2006.01) |
| ***A41D 13/012*** | (2006.01) |
| *B63B 35/79* | (2006.01) |

(52) U.S. Cl.

CPC ..... *B63C 9/115* (2013.01); *A41D 13/0125* (2013.01); *B63B 2035/7903* (2013.01)

USPC ..... 441/108; 441/113

(58) Field of Classification Search

USPC ..... 441/108, 113

IPC ..... B63C 9/115

See application file for complete search history.

(56) References Cited

U.S. PATENT DOCUMENTS

| | | | | |
|---|---|---|---|---|
| 5,459,874 | A * | 10/1995 | Meredith | 2/67 |
| 5,466,179 | A * | 11/1995 | Jeffrey, Sr. | 441/108 |
| 8,808,048 | B2 * | 8/2014 | Kent | 441/119 |
| 2005/0177922 | A1 | 8/2005 | Ikenaga et al. | |
| 2008/0188149 | A1 * | 8/2008 | Curry | 441/88 |
| 2010/0240272 | A1 * | 9/2010 | Cosson | 441/106 |

FOREIGN PATENT DOCUMENTS

| | | | |
|---|---|---|---|
| JP | 2003239116 | A | 8/2003 |
| RU | 2294677 | C2 | 3/2007 |
| RU | 97110 | U1 | 8/2010 |
| RU | 99932 | U1 | 12/2010 |

OTHER PUBLICATIONS

International Search Report and Written Opinion for related international Application No. PCT/US13/26607, dated Jun. 6, 2013, in 7 pages.

* cited by examiner

*Primary Examiner* — Stephen Avila

(74) *Attorney, Agent, or Firm* — Lisel M. Ferguson; Procopio, Cory, Hargreaves & Savitch LLP

(57) ABSTRACT

Apparatus for body surfing, and more particularly a body surfing buoyancy vest. The present invention relates to a buoyancy vest to be worn alone or under a body surfing suit or wetsuit which is able to regulate the buoyancy of the surfer to enable them to maintain maximum control and buoyancy balance in the water.

17 Claims, 3 Drawing Sheets

BUOYANCY VEST

CROSS-REFERENCE TO RELATED APPLICATIONS

This application claims the benefit of U.S. Provisional Patent Applications Ser. No. 61/600,441, filed Feb. 17, 2012, entitled "Buoyancy Vest" which is hereby incorporated by reference in its entirety.

FIELD OF THE INVENTION

The present invention relates, in general, to body surfing, and more particularly to a body surfing buoyancy vest. More particularly, the present invention relates to a buoyancy vest to be worn under a body surfing suit or wetsuit which is able to regulate the buoyancy of the surfer to enable them to maintain maximum control and buoyancy balance in the water.

BACKGROUND OF THE INVENTION

Body surfing is a way to enjoy the thrill of riding a wave in order to get the best ride the surfer must be buoyancy balanced. Body surfers, generally, simply extend their bodies horizontally, projecting their arms forward and in line with their body while allowing a breaking wave to drive them shoreward with the surf. To the body surfer, it is important to be able to ride waves of varied sizes, to enjoy a stable ride and to be able to control their bodies' direction and position and buoyancy on a wave face. Since a body surfer rarely uses any equipment other than swim fins, it is quite difficult for a body surfer to adequately control the stability of his ride and control his buoyancy.

The present invention seeks to overcome these limitations by providing the body surfer a means to stabilize his ride by controlling his/her buoyancy on the waves allowing his/her body to be in the proper position when the wave comes.

BRIEF DESCRIPTION OF THE DRAWINGS

The accompanying drawings, which are incorporated in and constitute a part of the specification, illustrate embodiments of the invention, and together with the description, serve to explain the objects, advantages, and principles of the invention. In the drawings.

DETAILED DESCRIPTION OF PREFERRED EMBODIMENTS

After reading this description it will become apparent to one skilled in the art how to implement the invention in various alternative embodiments and alternative applications. However, all the various embodiments of the present invention will be described herein, it is understood that these embodiments are presented by way of an example only, and not limitation. As such, this detailed description of various alternative embodiments should not be construed to limit the scope or breadth of the present invention as set forth below.

Figure 1:
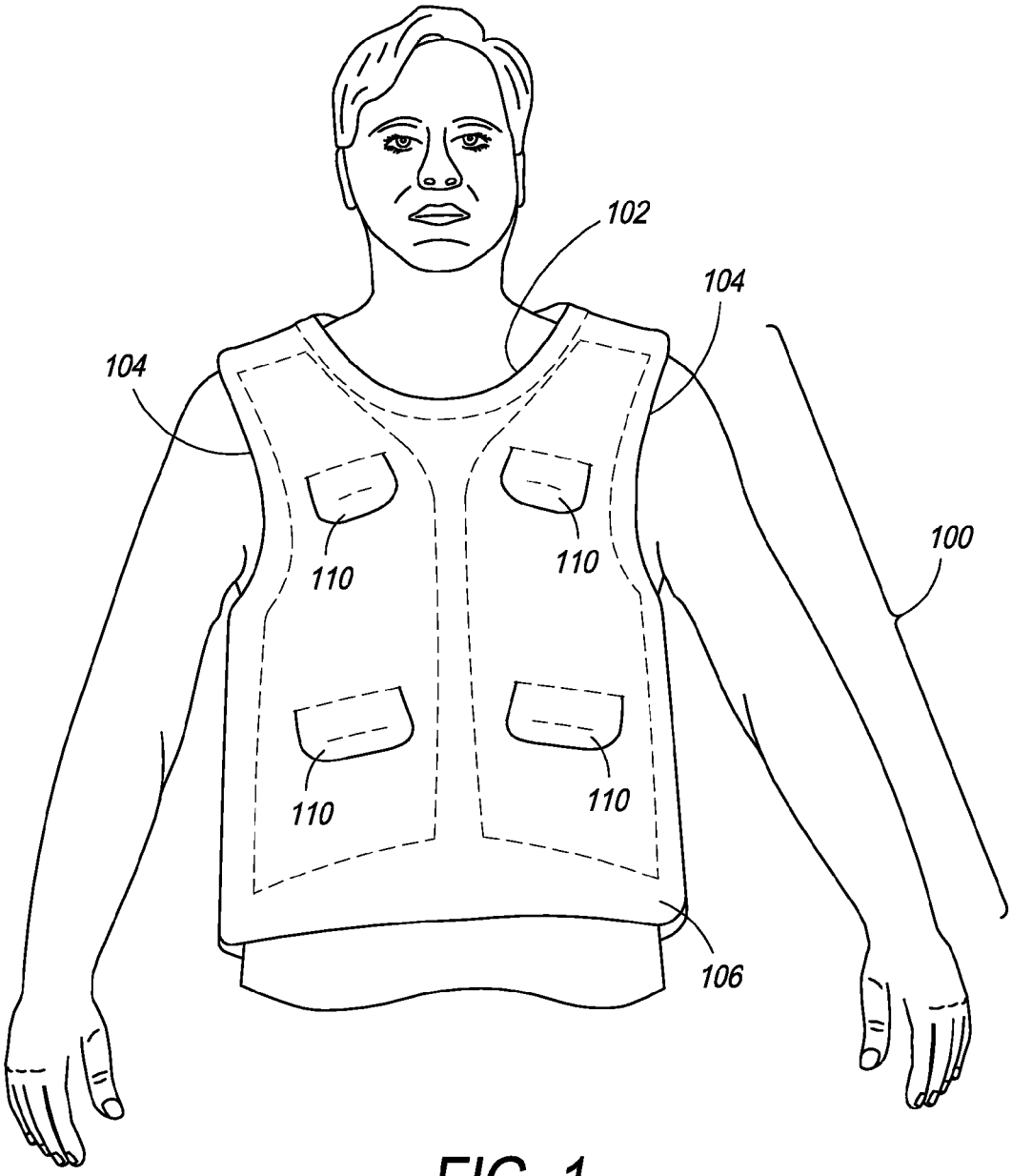
FIG. 1 is a front view of a buoyancy vest worn by a person in accordance with an embodiment of the invention.

With reference to FIG. 1, an embodiment of the buoyancy vest 100 is shown in a front view on a person. The buoyancy vest 100 is a vest worn on the user's upper torso to keep them more buoyant in the water. The buoyancy vest 100 includes a neck opening 102, a pair of arm holes 104, a front side 106 with an exterior surface and an interior surface, a back side 108 with an exterior surface and an interior surface (FIG. 2), pockets 110 and foam inserts 112 (FIG. 3) to be placed in the pockets 110. The buoyancy vest 100 is worn by a person either alone or under a surf suit or wet suit. In one embodiment the buoyancy vest 100 is pulled over the wearers head and meant to fit snuggly around the person's upper torso. The snug fit of the buoyancy vest 100 allows the user to be stream line in the water and does not allow water to sit between the inside of the vest 100 and the user's upper torso. In another preferred embodiment the buoyancy vest 100 opens down the middle of on the front side 106 by means of a zipper, Velcro or other type of attachment, see FIG. 3, so that the person wearing the vest can easily put it on and still allow for it to fit snuggly around the upper torso.

Figure 2:
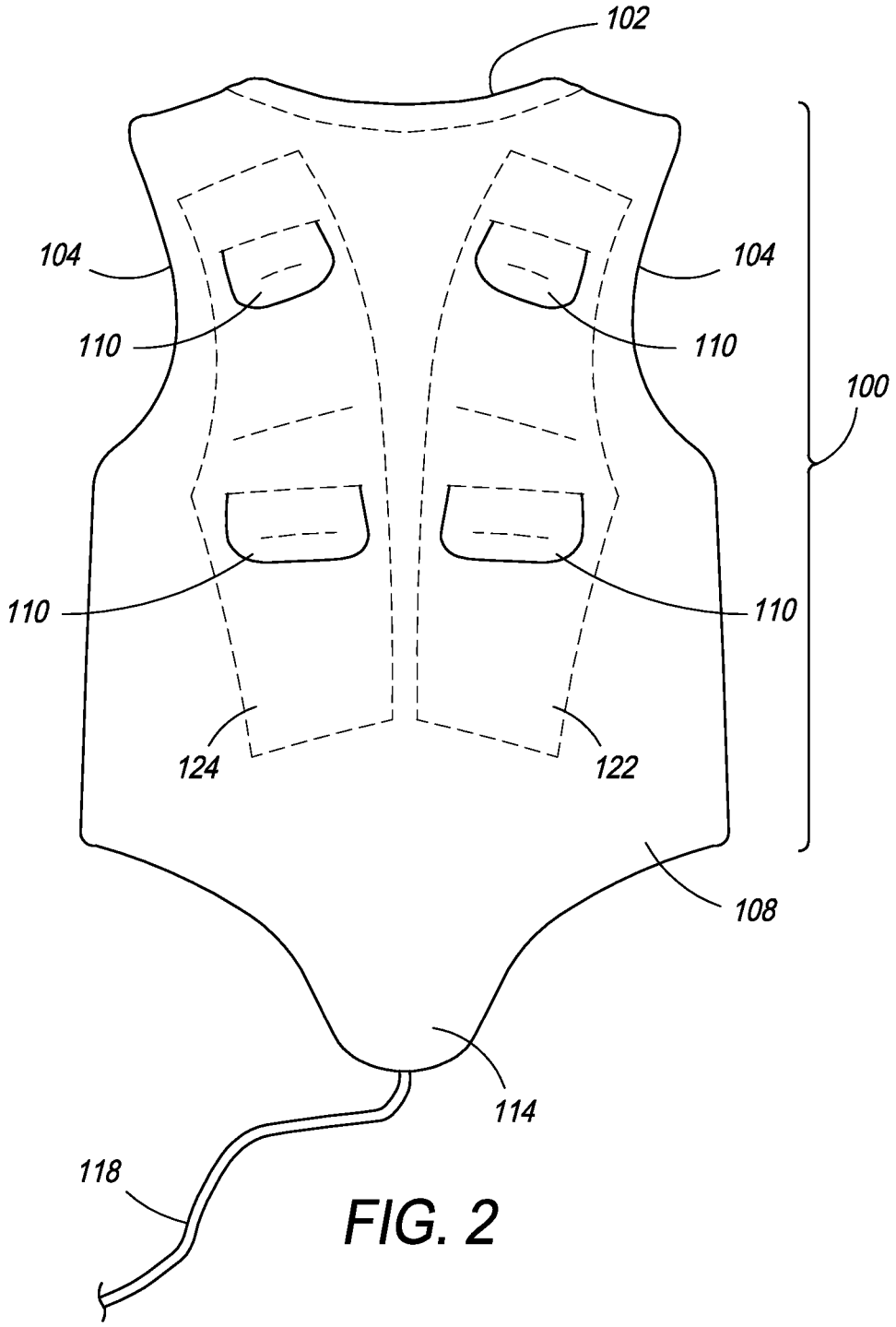
FIG. 2 is a rear view of a buoyancy vest in accordance with an embodiment of the invention.
Figure 3:
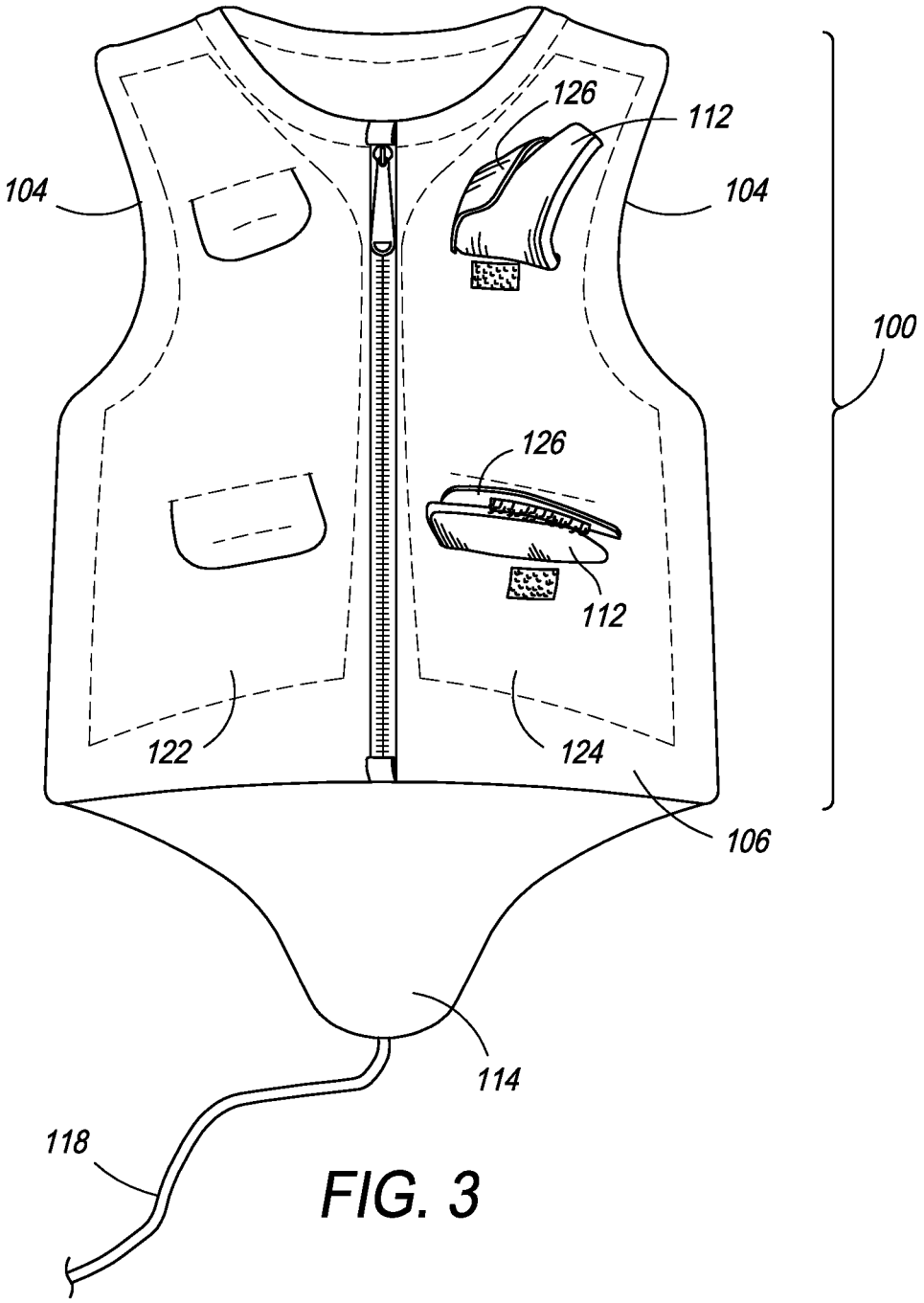
FIG. 3 is a front view of a buoyancy vest showing some buoyancy foam extending from the vest pockets.

Referring to FIGS. 1 and 2, the buoyancy vest 100 can have one or more pockets 110 on the front side 106 and/or back side 108. Referring to FIG. 3, the pockets 110 on the buoyancy vest 100 are configured to hold foam inserts 112. The buoyancy foam inserts 112 are placed into the pockets 110 allowing the person wearing the vest to control how buoyant they are in the water by choosing how many foam inserts 112 to place in the pockets. The foam can be inserted or removed to increase or decrease the buoyancy in the water. Thus one or more can be used and the size and density of the foam insets 112 can be changed. In some embodiments, the foam inserts 112 can be manufactured in various densities and thicknesses thereby allowing the wearer of the vest to further select how much buoyancy they desire. In one embodiment, the foam inserts 112 are a closed cell foam such as ethylene vinyl acetate ("EVA").

This buoyancy vest 100 is configured to be worn by a person who is bodysurfing so that they can control their buoyancy in the water, however this buoyancy vest 100 could be worn by anyone engaging in a number of types of water sports. The amount of buoyancy is controlled by adding or taking out foam inserts from the vest's 100 pockets 110. Referring to FIG. 2, in one embodiment the back side 108 has an extension on lower end referred to as a tab 114. This tab 114 extends down and rests on the wearers gluteus maximus and can be grabbed by the wearer to pull the vest up and over the wearers head for removal of the buoyancy vest 100. In some embodiments there is a string or rope 118 attached to the tab 114. This string 118 can be easily reached by the person wearing the vest 100 and therefore allows them to pull on the string 118 and pull the vest 100 up over their head to access the tab 114 and pull the vest over their head to remove.

The buoyancy vest 100 is preferably constructed from neoprene or other lightweight, stretchable, water, chemical and UV resistant material. In another preferred embodiment the buoyancy vest 100 is constructed from a buoyant material. For example, this material of the vest 100 maybe fabricated from neoprene in various thicknesses. In one embodiment, the thickness of the neoprene or buoyant material is from ½ to 20 millimeter. A thicker neoprene vest provides more buoyancy and allows the surfer to body surf in colder waters since neoprene keeps the body temperature elevated. Referring to FIGS. 2 and 3, in one embodiment, the front side 106 and the back side 108 have a right and a left panel 122 and 124. These panels have an additional layer of neoprene on the inside of the vest which is stretched or glued to the inside of the vest around the circumference of the panel. The pockets 110 of the vest are then cut through the outside of the vest panel 122 and 124, and inserted between the two layers of neoprene formed by the panels 122 and 124. The buoyancy foam 112 can then slide into the pockets made in the panels 122 and 124, see FIG. 3. In one preferred embodiment, each pocket has an exterior flap 126, which folds over the opening of the pocket and Velcros or attaches by other means to the exterior vest. These exterior flaps 126 cover the pockets so that the buoyancy foam 112 does not fall out.

The above description of disclosed embodiments is provided to enable any person skilled in the art to make or use the invention. Various modifications to the embodiments will be readily apparent to those skilled in the art; the generic principals defined herein can be applied to other embodiments without departing from spirit or scope of the invention. Thus, the invention is not intended to be limited to the embodiments shown herein but is to be accorded the widest scope consistent with the principals and novel features disclosed herein.

What is claimed is:

1. A vest which enables the user to control their buoyancy in the water comprising:

a neck opening;

a pair of arm holes;

a front side with an exterior and interior surface and one or more pockets each having an opening on the exterior surface;

a back side with an exterior and interior surface and one or more pockets each having an opening on the exterior surface;

a plurality of foam inserts configured for selective engagement through the openings into the pockets on the front side and the back side for user control of the amount of buoyancy of the user;

the back side has a lower end and a tab extending downward from the lower end of the back side; and the back side has a string or rope having one end attached to the tab whereby the string or rope extends downward from the tab, the tab and string or rope being configured to allow the user to pull the vest over their head.

2. The vest of claim 1, wherein the foam inserts are made of different densities and thicknesses.

3. The vest of claim 1, which includes a zipper on the front side.

4. The vest of claim 1, constructed from one or more layers of neoprene.

5. The vest of claim 4, wherein the neoprene has a thickness in the range of ½ to 20 millimeter.

6. The vest of claim 1, wherein the pockets have an exterior flap which folds over the opening of the pocket and attaches to the exterior of the vest.

7. A vest constructed of one or more layers of buoyant fabric which includes:

a neck opening;

a pair of arm holes;

a front side with one or more pockets each pocket having an opening on the front side for access into the pocket;

a back side having a lower end portion comprising a tab;

a plurality of foam inserts configured for selective engagement through the one or more openings into the one or more pockets;

a string having a first end attached to the tab, the tab and string being configured to allow a wearer to pull the vest over their head; and the vest being constructed of a buoyant material.

8. The vest of claim 7, wherein the foam inserts are made of different densities and thicknesses.

9. The vest of claim 7, which includes a zipper on the front side.

10. The vest of claim 7, wherein part or all of the vest is constructed from one or more layers of neoprene.

11. The vest of claim 7, wherein the foam inserts are constructed of a closed cell foam.

12. The vest of claim 1, wherein the buoyant material has a thickness in the range of ½ to 20 millimeter.

13. The vest of claim 7, wherein the pockets have an exterior flap which folds over the opening of the pocket and attaches to the exterior of the vest.

14. The vest of claim 11, wherein the closed cell foam comprises ethylene vinyl acetate.

15. The vest of claim 4, wherein the front side and the back side each have right and left panels each formed by two layers of neoprene and the pockets are formed between the two layers of neoprene and accessed through the openings in the exterior surface of the respective front and back sides of the vest.

16. The vest of claim 1, wherein the front and back side of the vest each have at least an upper and a lower pocket.

17. The vest of claim 16, wherein the front and back side of the vest each have an upper and a lower left pocket and an upper and a lower right pocket.

* * * * *